US010511095B2

(12) United States Patent
Lee et al.

(10) Patent No.: US 10,511,095 B2
(45) Date of Patent: Dec. 17, 2019

(54) ANTENNA MODULE

(71) Applicant: WITS Co., Ltd., Yongin-si, Gyeonggi-do (KR)

(72) Inventors: Chang Hee Lee, Suwon-si (KR); Young Seung Roh, Suwon-si (KR); Jae Sun Won, Suwon-si (KR); Hee Seung Kim, Suwon-si (KR); Hyo Jung Yoon, Suwon-si (KR); Gie Hyoun Kweon, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 61 days.

(21) Appl. No.: 15/806,651

(22) Filed: Nov. 8, 2017

(65) Prior Publication Data

US 2018/0277954 A1 Sep. 27, 2018

(30) Foreign Application Priority Data

Mar. 24, 2017 (KR) ..... 10-2017-0037871
May 25, 2017 (KR) ..... 10-2017-0064784

(51) Int. Cl.

| | |
|---|---|
| ***H01Q 1/00*** | (2006.01) |
| ***H01Q 7/00*** | (2006.01) |
| ***H01Q 1/38*** | (2006.01) |
| ***H01Q 7/06*** | (2006.01) |
| ***H01Q 9/27*** | (2006.01) |

(52) U.S. Cl.

CPC ..... *H01Q 7/00* (2013.01); *H01Q 1/38* (2013.01); *H01Q 7/06* (2013.01); *H01Q 9/27* (2013.01)

(58) Field of Classification Search

CPC .. H01Q 7/00; H01Q 9/27; H01Q 1/38; H01Q 7/06

See application file for complete search history.

(56) References Cited

U.S. PATENT DOCUMENTS

| | | | | |
|---|---|---|---|---|
| 2012/0208606 | A1* | 8/2012 | Kubo | G06K 19/07779 455/575.7 |
| 2013/0147675 | A1* | 6/2013 | Kato | H01Q 1/38 343/788 |
| 2014/0145906 | A1 | 5/2014 | Kato et al. | |
| 2016/0261026 | A1* | 9/2016 | Han | H01Q 1/243 |
| 2018/0254552 | A1* | 9/2018 | Ito | H02J 50/12 |

FOREIGN PATENT DOCUMENTS

| | | | |
|---|---|---|---|
| CN | 102687338 | A | 9/2012 |
| CN | 103053074 | A | 4/2013 |
| CN | 103918192 | A | 7/2014 |

(Continued)

OTHER PUBLICATIONS

Chinese Office Action dated Oct. 8, 2019 issued in corresponding Chinese Patent Application No. 201810077868.X.

*Primary Examiner* — Dieu Hien T Duong

(74) *Attorney, Agent, or Firm* — Harness, Dickey & Pierce, P.L.C.

(57) ABSTRACT

An antenna module includes a coil part including a second antenna wiring formed on an insulating substrate in a spiral shape and a first antenna wiring disposed in an internal region of the second antenna wiring, and a magnetic part including a first magnetic part disposed in the internal region of a first surface of the insulating substrate and a second magnetic part disposed on a second surface of the insulating substrate.

20 Claims, 16 Drawing Sheets

(56) References Cited

FOREIGN PATENT DOCUMENTS

| | | | |
|---|---|---|---|
| CN | 105939162 | A | 9/2016 |
| JP | 2002324221 | A | 11/2002 |
| JP | 2004-348497 | A | 12/2004 |
| JP | 4265114 | B2 | 5/2009 |
| JP | 5987963 | B2 | 9/2016 |

* cited by examiner

ANTENNA MODULE

CROSS-REFERENCE TO RELATED APPLICATION(S)

This application claims the benefit under 35 USC § 119(a) of Korean Patent Application Nos. 10-2017-0037871 filed on Mar. 24, 2017 and 10-2017-0064784 filed on May 25, 2017 in the Korean Intellectual Property Office, the entire disclosures of which are incorporated herein by reference for all purposes.

BACKGROUND

1. Field

This application relates to an antenna module mounted in an electronic device and is used for local area network communications.

2. Description of Related Art

As portable terminals, such as smartphones, have become common and their functions have improved, payment methods using local area network communications of portable terminals have emerged. However, since a data transmission channel may not be present between the portable terminal and a point-of sales (POS) terminal, which are typically provided in a store or other places of business, processing payments using the smartphones may be arduous. Use of a 2D barcode or near field communications (NFC) have been proposed to overcome these obstacles.

In addition, magnetic secure transmission (MST) method capable of performing payment without adding a separate reading apparatus to the POS terminal has been recently proposed.

As a result, it may be desirous to mount both an NFC antenna and an MST antenna on a single portable terminal. Thus, an antenna module capable of maintaining communications performances of respective antennas in the portable terminal is desirable.

SUMMARY

This Summary is provided to introduce a selection of concepts in a simplified form that are further described below in the Detailed Description. This Summary is not intended to identify key features or essential features of the claimed subject matter, nor is this Summary intended to be used as an aid in determining the scope of the claimed In one general aspect, there is provided an antenna module including a coil part including a second antenna wiring formed on an insulating substrate in a spiral shape and a first antenna wiring disposed in an internal region of the second antenna wiring, and a magnetic part including a first magnetic part disposed in the internal region of a first surface of the insulating substrate and a second magnetic part disposed on a second surface of the insulating substrate, wherein the entirety of the first magnetic part is disposed in the internal region of the second antenna wiring.

The first antenna wiring may include a first pattern disposed on the first surface of the insulating substrate, a second pattern disposed on the second surface of the insulating substrate, and interlayer connection conductors penetrating the insulating substrate and being configured to connect the first pattern to the second pattern.

The first magnetic part may be disposed in a portion of the internal region where the first pattern is not formed.

The first magnetic part may include a body part disposed to face the second pattern, and a magnetic flux connecting part extending from the body part of the first magnetic part, and being disposed in an internal region of the first antenna wiring.

The second magnetic part may include a body part disposed to face the first pattern and the second antenna wiring disposed around the first pattern, a magnetic flux connecting part disposed in an internal region of the first antenna wiring, and an extending part disposed to face the second antenna wiring disposed around the second pattern.

The extending part extends from the body part and may be formed as a band along an outer portion of the insulating substrate.

An area of the extending part may be wider than areas of other portions.

The extending part may extend from the body part and may be disposed to support a portion of the second antenna wiring disposed around the second pattern.

The first antenna wiring may include a first wiring and a second wiring, spaced apart from each other, and the first magnetic part may include a first magnetic flux connecting part disposed in an internal region of the first wiring and a second magnetic flux connecting part disposed in an internal region of the second wiring.

The second magnetic part may include a first body part disposed to face the first wiring and the second antenna wiring disposed around the first wiring, a first magnetic flux connecting part extended from the first body part and disposed in the internal region of the first wiring, a second body part disposed to face the second wiring and the second antenna wiring disposed around the second wiring, a second magnetic flux connecting part extended from the second body part and disposed in the internal region of the second wiring, and a connecting part connecting the first body part to the second body part and being disposed to face the second antenna wiring.

The insulating substrate may have a through-hole formed in the center region of the first antenna wiring.

The first magnetic part and the second magnetic part may respectively include an insertion portion configured to be inserted into the through-hole.

The antenna module may include a third antenna wiring disposed on the first surface of the insulating substrate, and a portion of the second magnetic part may be configured to face the third antenna wiring.

The second magnetic part may include a body part disposed to face the first pattern and the second antenna wiring disposed around the first pattern, and a magnetic flux connecting part extending from the body part of the second magnetic part, and being disposed in the internal region of the first antenna wiring, and the magnetic flux connecting part of the first magnetic part may be spaced apart from the magnetic flux connecting part of the second magnetic part are disposed in a surface direction of the insulating substrate.

The first antenna wiring may protrude from the substrate, and a height of the protrusion of the first antenna wiring may be similar to a thickness of the magnetic part.

The second antenna wiring may protrude from the substrate, and a height of the protrusion of the second antenna wiring may be similar to a thickness of the magnetic part.

A size of the first magnetic part may be different from a size of the second magnetic part.

In another general aspect, there is provided an antenna module including a first antenna wiring dispersedly disposed on a first surface and a second surface of an insulating substrate, a first magnetic part disposed on the first surface of the insulating substrate and disposed to be spaced apart from the first antenna wiring, a second magnetic part disposed on the second surface of the insulating substrate and disposed to be spaced apart from the first antenna wiring, and a second antenna wiring disposed on the first surface of the insulating substrate and disposed around the first antenna wiring and the first magnetic part.

A portion of the first magnetic part may be disposed to face the first antenna wiring disposed on the second surface of the insulating substrate, and a portion of the second magnetic part may be disposed to face the first antenna wiring disposed on the first surface of the insulating substrate.

The second magnetic part may be disposed to face at least a portion of the second antenna wiring.

In another general aspect, there is provided an antenna module including a first antenna wiring formed along the edges of a first surface of an insulating substrate, a second antenna wiring formed inside the first antenna wiring, the second wiring including a first pattern disposed on the first surface, a second pattern disposed on a second surface of the insulating substrate that opposes the first surface, interlayer connection conductors penetrating the insulating substrate to connect the first pattern to the second pattern, and a first magnetic part disposed on portions of the first surface where the first pattern may be absent and a second magnetic part disposed on portions of the second surface where the second pattern may be absent.

The insulating substrate may be divided by the interlayer connection conductors, and the first pattern may be disposed on one side of the interlayer connection conductors and the second pattern may be disposed on the other side of the interlayer connection conductors.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for the purposes of clarity, illustration, and convenience.

DETAILED DESCRIPTION

Figure 1:
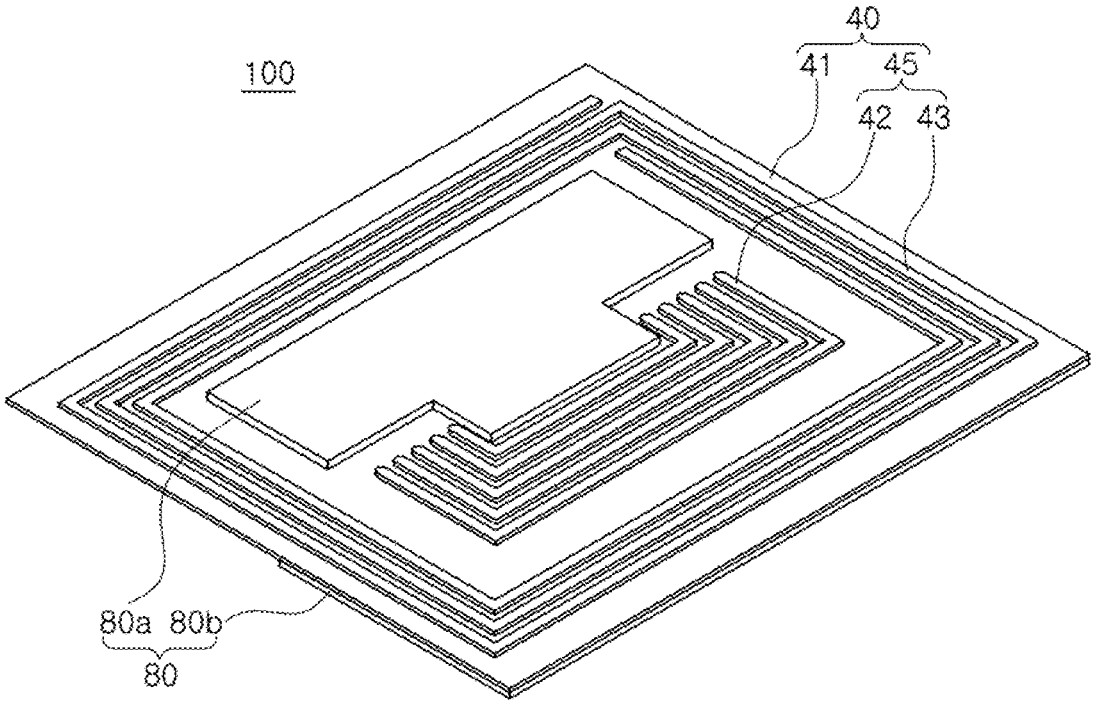
FIG. 1 is a diagram illustrating an example of an antenna module.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after gaining a thorough an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

Throughout the specification, when an element, such as a layer, region, or substrate, is described as being "on," "connected to," "coupled to," "over," or "covering" another element, it may be directly "on," "connected to," "coupled to," "over," or "covering" the other element, or there may be one or more other elements intervening therebetween. In contrast, when an element is described as being "directly on," "directly connected to," "directly coupled to," "directly over," or "directly covering" another element, there can be no other elements intervening therebetween.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. As used herein, the term "and/or" includes any one and any combination of any two or more of the associated listed items.

Due to manufacturing techniques and/or tolerances, variations of the shapes shown in the drawings may occur. Thus, the examples described herein are not limited to the specific shapes shown in the drawings, but include changes in shape that occur during manufacturing.

All documents cited in the present disclosure, including published documents, patent applications, and patents, may be incorporated herein in their entirety by reference in the same manner as when each cited document is separately and specifically incorporated or incorporated in its entirety.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Figure 2:
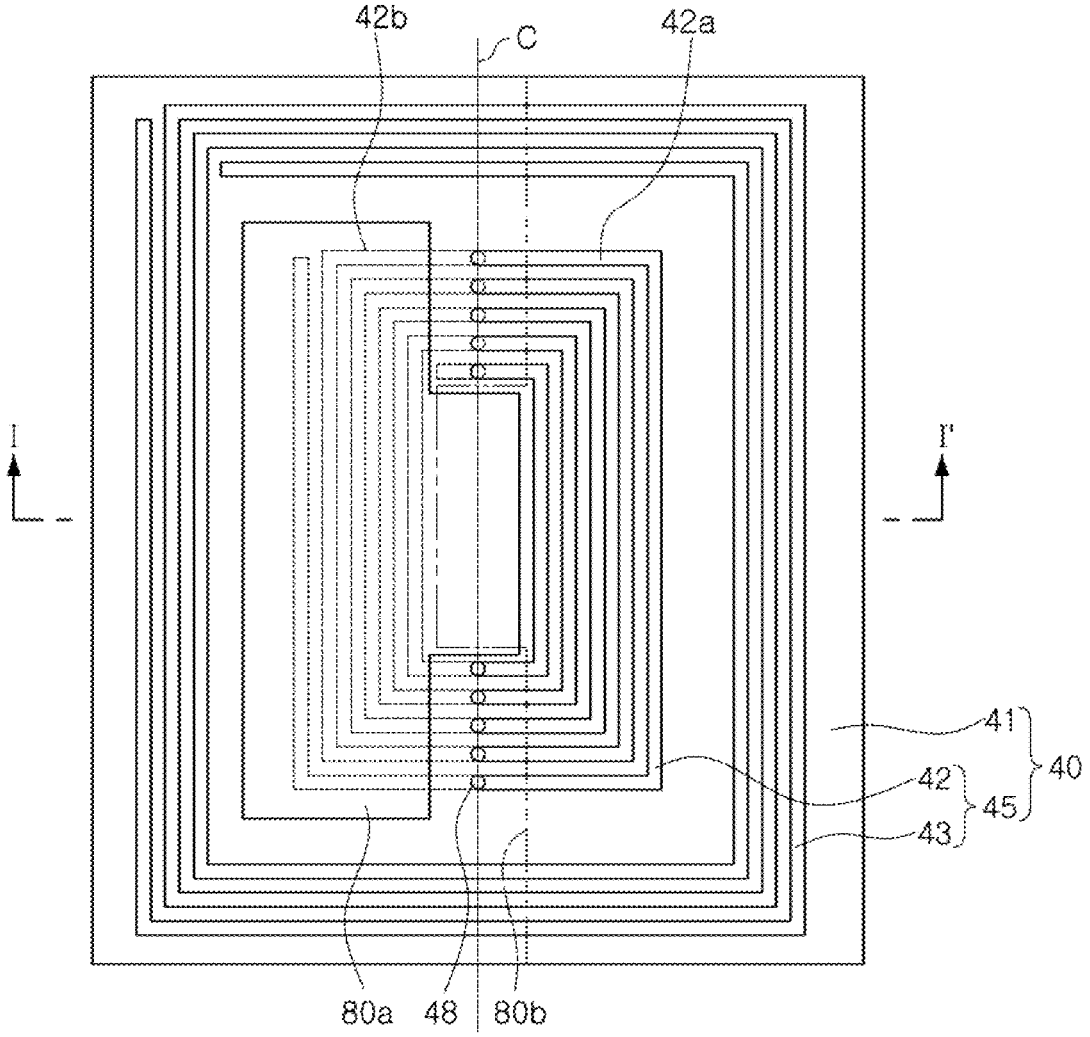
FIG. 2 is a diagram illustrating an example of the antenna module illustrated in FIG. 1.
Figure 3:
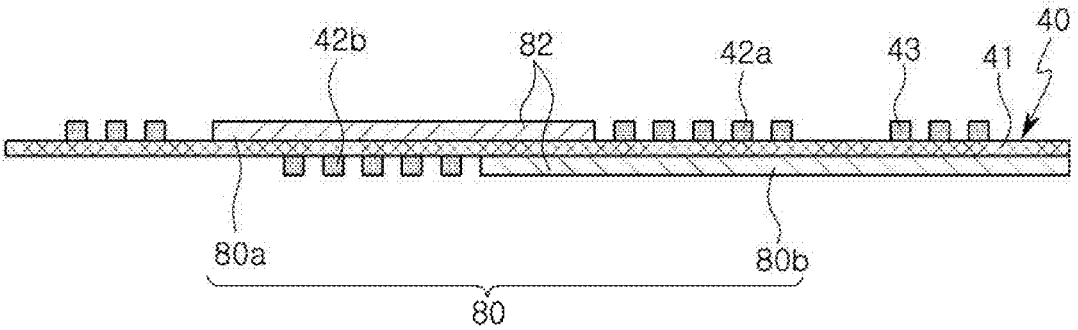
FIG. 3 is a diagram illustrating an example of a cross-sectional view taken along a line I-I' of FIG. 2.
Figure 4:
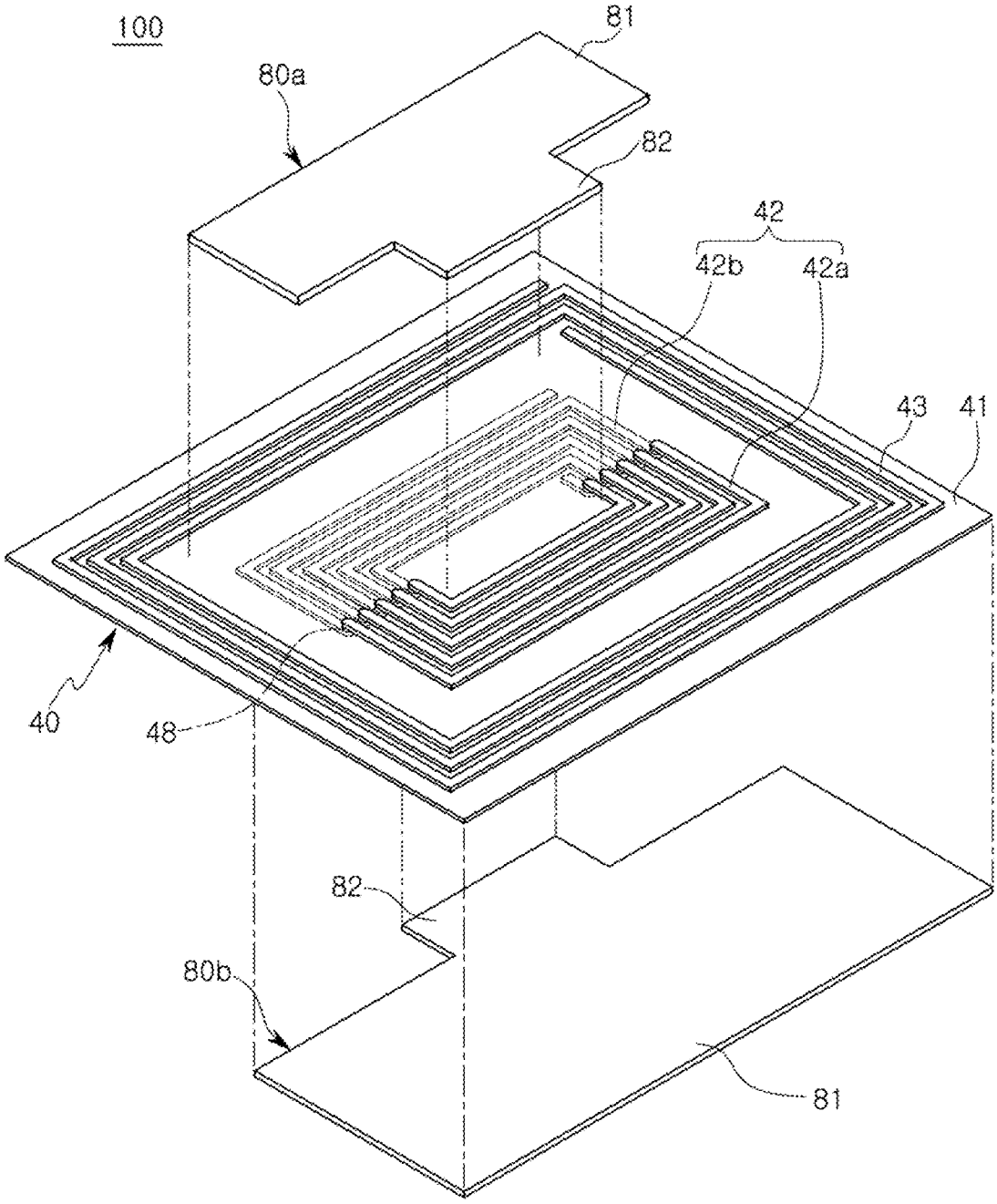
FIG. 4 is a diagram illustrating an example of the antenna module illustrated in FIG. 1.

FIGS. 1 and 2 are diagrams illustrating an example of an antenna module, and FIG. 3 is a diagram illustrating an example of a cross-sectional view taken along a line I-I' of FIG. 2. FIG. 4 is a diagram illustrating an example of the antenna module illustrated in FIG. 1.

Referring to FIGS. 1 through 4, an antenna module 100 is illustrated. The antenna module 100 is mounted in an electronic device and is used for local area network communications. In an example, the antenna module 100 includes a coil part 40 and a magnetic part 80.

In an example, the coil part 40 includes an insulating substrate 41, and an antenna wiring 45 formed on the insulating substrate 41.

The insulating substrate 41 refers to a substrate where a circuit wiring is formed one surface, or circuits are formed on opposing surfaces of the substrate. For example, an insulating film (e.g., a polyimide film) may be used as the substrate. In this case, the coil part 40 may have a form of a flexible printed circuit board (PCB). Other types substrates, such as, for example, a printed circuit board, a ceramic substrate, a glass substrate, an epoxy substrate, or a flexible substrate are considered to be well within the scope of the present disclosure. In an example, any type of substrate may be selectively used as long as the circuit wiring may be formed on the opposite surfaces of the substrate.

In an example, antenna wiring 45 is formed on the opposite surfaces of the insulating substrate 41 and may have a form of circuit wiring formed of a copper foil, or the like.

In an example, the antenna wiring 45 is manufactured by patterning double sided copper clad laminates (CCL). In an example, the antenna wiring 43 is formed by performing photolithography for the opposite surfaces of a flexible insulating substrate such as, a film, and the coil part 40 is manufactured for example as flexible PCB (FPCB) having a double sided structure.

In an example, the coil part 40 has a thickness that is thin. In another example, the antenna wiring 43 is manufactured in a multilayer substrate, or in a form of the printed circuit board (PCB) having desired rigidity.

In an example the antenna wiring 45 is formed in a form in which the antenna wiring 43 protrudes from the insulating substrate 41, and not a form in which the antenna wiring 43 is embedded in the insulating substrate 41. In this case, a distance at which the antenna wiring 45 protrudes may be similar to or the same as a thickness of a magnetic part 80 to be describe below. However, the antenna wiring 45 is not limited thereto and other arrangements of the antenna wiring 45 are considered to be well within the scope of the present disclosure.

In an example, the antenna wiring 45 is formed of a single line coil. In another example, the antenna wiring 45 is formed of a coil of a Litz wire form formed of several strands.

In an example, the antenna wiring 45 includes a first antenna wiring 42 and a second antenna wiring 43. In an example, each of the first antenna wiring 42 and the second antenna wiring 43 has a spiral shape.

In an example, the first antenna wiring 42 includes a first pattern 42*a* disposed on a first surface of the insulating substrate 41, a second pattern 42*b* disposed on a second surface, and interlayer connection conductors 48 that connects the first pattern 42*a* and the second pattern 42*b* with each other. The first surface and the second surface of the insulating substrate 41 are surfaces opposing each other. The interlayer connection conductors 48 is disposed in the insulating substrate 41 to penetrate through the insulating substrate 41. In an example, the interlayer connection conductors 48 electrically connects the first pattern 42*a* and the second pattern 42*b*.

When the insulating substrate 41 is divided by a dividing line C in FIG. 2, the first pattern 42*a* may be disposed on one side of the insulating substrate 41 and the second pattern 42*b* may be disposed on the other side of the insulating substrate 41. In an example, the interlayer connection conductors 48 are disposed along the dividing line C. In an example, the interlayer connection conductors 48 are connected with each other along the dividing line C.

Accordingly, a continuous spiral shape of the first antenna wiring 42 may be completed by the first pattern 42*a*, the second pattern 42*b*, and the interlayer connection conductors 48. In an example, the first antenna wiring 42 is formed in a spiral shape in which a half of a turn of the antenna wiring 42 is alternately disposed on the first surface and the second surface of the insulating substrate 41.

In an example, the first pattern 42*a* and the second pattern 42*b* each include a plurality of linear patterns that are disposed in parallel. The linear patterns may be disposed to have concentricity.

In an example, the linear patterns of the first pattern 42*a* are each connected to the linear patterns of the second pattern 42*b* through the interlayer connection conductors 48. Therefore, the linear pattern of one first pattern 42*a* and one second pattern 42*b* may be connected to each other through the interlayer connection conductor 48 to form one coil turn.

By such an antenna structure, half of the first antenna wiring 42 may be disposed on the first surface of the insulating substrate 41, and the other half of the first antenna wiring 42 is disposed on the second surface of the insulating substrate 41.

An overall contour of the first antenna wiring 42 may be an annular shape (or a ring shape). In an example, an empty internal region in which the first antenna wiring 42 is not formed is formed at a center of the first antenna wiring 42. Hereinafter, the internal region of the first antenna wiring 42 refers to a region which is disposed at the center of the first antenna wiring 42 and does not have the first antenna wiring 42 formed therein.

In an example, the first antenna wiring 42 is used as a magnetic secure transmission (MST) antenna. However, the first antenna wiring 42 is not limited thereto, and the first antenna wiring 42 may be used for other purposes without departing from the spirit and scope of the illustrative examples described.

In an example, the second antenna wiring 43 is disposed on the first surface of the insulating substrate 41, and may be entirely exposed to the outside of a magnetic part 80 to be described below. However, the second antenna wiring 43 is not limited thereto, and in other examples, the second antenna wiring 43 is disposed on the second surface of the insulating substrate 41 or dispersedly disposed on the opposite surfaces of the insulating substrate 41, similarly to the first antenna wiring 42.

The second antenna wiring 43 may be disposed along an outer portion of the insulating substrate 41. In an example, an overall contour of the second antenna wiring 43 is an annular shape (or a ring shape). Therefore, an empty internal region in which the second antenna wiring 43 is not formed may be formed at a center of the second antenna wiring 43. Hereinafter, the internal region of the second antenna wiring 43 refers to a region which is disposed at the center of the second antenna wiring 43 and does not have the second antenna wiring 43 formed therein.

In an example, the first antenna wiring 42 is disposed in the internal region of the second antenna wiring 43. Therefore, the second antenna wiring 43 may be disposed on an outer side of the first antenna wiring 42 so as to accommodate the first antenna wiring 42 therein.

In an example, the second antenna wiring 43 is used as a near field communication (NFC) antenna. However, the second antenna wiring 43 is not limited thereto, and the second antenna wiring 43 may be used for other purposes without departing from the spirit and scope of the illustrative examples described.

In an example, the magnetic part 80 is used as a magnetic path of a magnetic field generated by the antenna wiring 45 of the coil part 40, and is provided to efficiently form the magnetic path of the magnetic field. In an example, the magnetic part 80 is formed of a material capable of easily forming the magnetic path, such as, for example, a material having permeability such as a ferrite, a nanocrystal magnetic material, an amorphous magnetic material, a silicon steel plate.

In an example, the magnetic part 80 is formed in a flat plate shape such as a sheet and is disposed on opposite surfaces of the coil part 40, respectively.

In an example, the magnetic part 80 includes a first magnetic part 80*a* disposed on one surface of the coil part 40 (e.g., the first surface of the insulating substrate), and a second magnetic part 80*b* disposed on the other surface of the coil part 40 (e.g., the second surface of the insulating substrate). Therefore, the insulating substrate 41 of the coil part 40 may be disposed to be interposed between the first magnetic part 80*a* and the second magnetic part 80*b*.

In an example, the first magnetic part 80*a* and the second magnetic part 80*b* are disposed on the opposite surfaces of the insulating substrate 41, and are disposed on regions on which the antenna wiring 42 is not present.

In an example, both the first magnetic part 80*a* and the first pattern 42*a* are disposed on the first surface of the insulating substrate 41, and the first magnetic part 80*a* is disposed on a region in which the first pattern 42*a* is not formed, so as not to overlay with the first pattern 42*a*.

Similarly, both the second magnetic part 80*b* and the second pattern 42*b* are disposed on the second surface of the insulating substrate 41, and the second magnetic part 80*b* is disposed on a region in which the second pattern 42*b* is not formed, so as not to overlay with the second pattern 42*b*.

Accordingly, the first magnetic part 80*a* is disposed to face the second pattern 42*b* and the second magnetic part 80*b* is disposed to face the first pattern 42*a*, while having the insulating substrate 41 interposed therebetween.

In an example, the entirety of the first magnetic part 80*a* may be disposed in an internal region of the second antenna wiring 43, so as to expose the second antenna wiring 43. Accordingly, the first magnetic part 80*a* may be disposed in a region in which the first pattern 42*a* of the first antenna wiring 42 is not formed in the internal region formed by the second antenna wiring 43.

Each of the first magnetic part 80*a* and the second magnetic part 80*b* may have the insulating substrate 41 interposed therebetween. As shown in FIG. 4, each of the first magnetic part 80*a* and the second magnetic part 80*b* may be classified into a body part 81 disposed to face the first antenna wiring 42 and a magnetic flux connecting part 82 disposed in the internal region of the first antenna wiring 42.

In an example, the body part 81 of the first magnetic part 80*a* may be disposed to face the second pattern 42*b* formed on the second surface of the insulating substrate 41. In an example, the body part 81 of the second magnetic part 80*b* may be disposed to face the first pattern 42*a* formed on the first surface of the insulating substrate 41 and the second antenna wiring 43 disposed around the first pattern 42*a*.

In an example, the second magnetic part 80*b* may face a portion of the second antenna wiring 43. In other example, the second magnetic part 80*b* may also face the entirety of the second antenna wiring 42 as described in some of the examples below.

Both the magnetic flux connecting parts 82 of the first magnetic part 80*a* and the second magnetic part 80*b* may be disposed in the internal region of the first antenna wiring 42. Therefore, the magnetic flux connecting parts 82 of the first magnetic part 80*a* and the second magnetic part 80*b* may be disposed to face each other while having the insulating substrate 41 interposed therebetween.

In an example where the magnetic flux connecting parts 82 are disposed to face each other as described in the present disclosure, the first magnetic part 80*a* and the second magnetic part 80*b* may provide magnetic paths that significantly decrease magnetic flux resistance through the magnetic flux connecting parts 82. Therefore, efficiency of the antenna module 100 is significantly increased. However, the configuration of the present disclosure is not limited thereto.

In an example, the first magnetic part 80*a* and the second magnetic part 80*b* of the antenna module 100 may have different sizes. In an example, the second magnetic part 80*b* has an area that is greater than that of the first magnetic part 80*a*. This configuration may be deduced by disposing the entirety of the first magnetic part 80*a* in the internal region of the second antenna wiring 43 and disposing the second magnetic part 80*b* to face the second antenna wiring 43 disposed around the first pattern 42*a* as well as the first pattern 42*a*.

In such a configuration, the second magnetic part 80*b* may prevent the magnetic field formed by the second antenna wiring 43 as well as the magnetic field formed by the first pattern 42*a* from being leaked toward a rear surface of the second magnetic part 80*b*. As a result, radiation efficiency may be increased.

When the magnetic part 80 and the antenna wirings 42 and 43 have a great thickness difference, a thickness of the antenna module 100 may be non-uniform and a thickness deviation may occur. In this case, it may be difficult to mount the antenna module in an electronic device.

Therefore, in an example, the magnetic part 80 has a thickness that is the same as or similar to the thickness of the antenna wirings 42 and 43.

In an example, the antenna module 100 has an adhesive member (not shown) interposed between the coil part 40 and the magnetic part 80 so that the coil part 40 and the magnetic part 80 are firmly fixed and adhered to each other.

The adhesive member may be disposed between the coil part 40 and the magnetic part 80 and may bond the magnetic part 80 and the coil part 40 to each other. In an example, such an adhesive member may be formed by an adhesive sheet or an adhesive tape, and may also be formed by coating the surface of the coil part 40 or the magnetic part 80 with an adhesive or a resin having adhesive property.

In an example, the adhesive member may have magnetic property by configuring the adhesive member to contain ferrite powders.

Since the antenna module 100 is manufactured in a form of a flat and thin substrate by attaching the magnetic part 80 onto the opposite surfaces of the coil part 40, but a direction of the magnetic field generated by the first antenna wiring 42 is formed in a surface direction of the antenna module 100, the antenna module 100 may be operated in the same form as a solenoid antenna.

Therefore, a shape or a direction of the magnetic field generated by the first antenna wiring 42 of the antenna module 100 may be adjusted to a specific direction.

In addition, since the antenna module 100 may be manufactured only by an operation of stacking the magnetic part 80 on the opposite surfaces of the coil part 40, the antenna module 100 may be easily manufactured.

Meanwhile, the antenna module described above may be variously modified without departing from the spirit and scope of the illustrative examples described.

Figure 5:
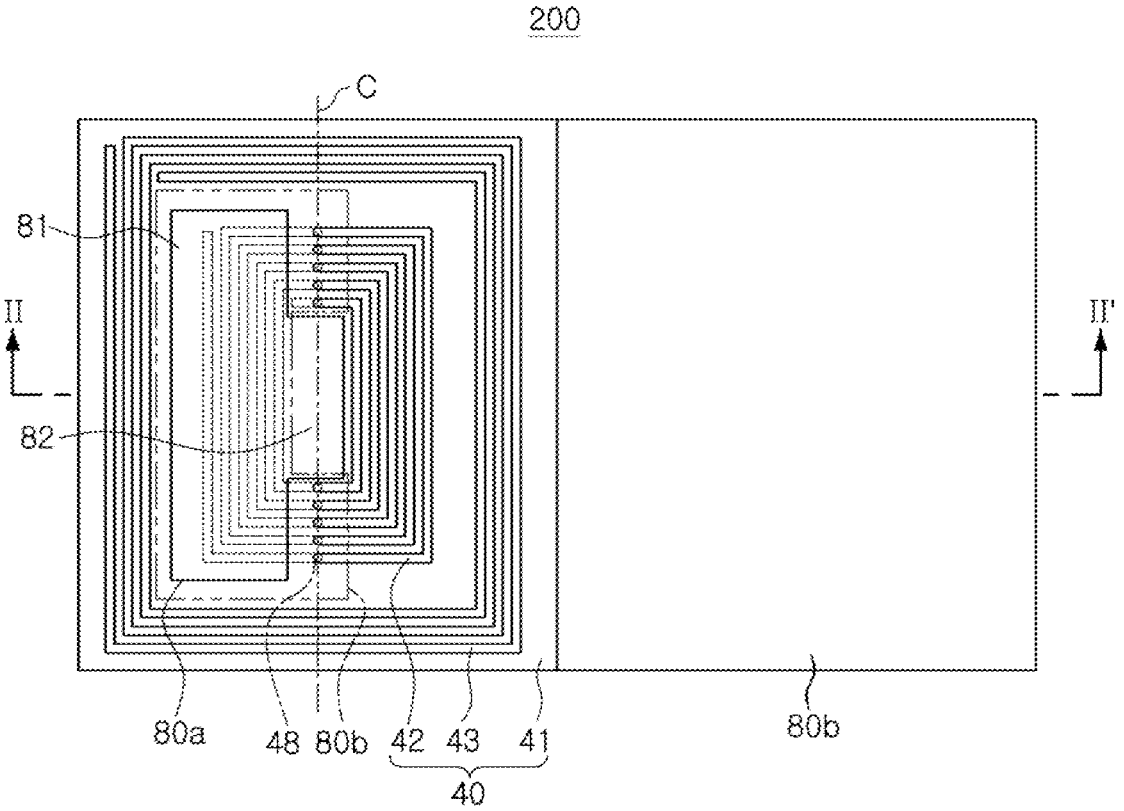
FIG. 5 is a diagram illustrating an example of an antenna module.
Figure 6:
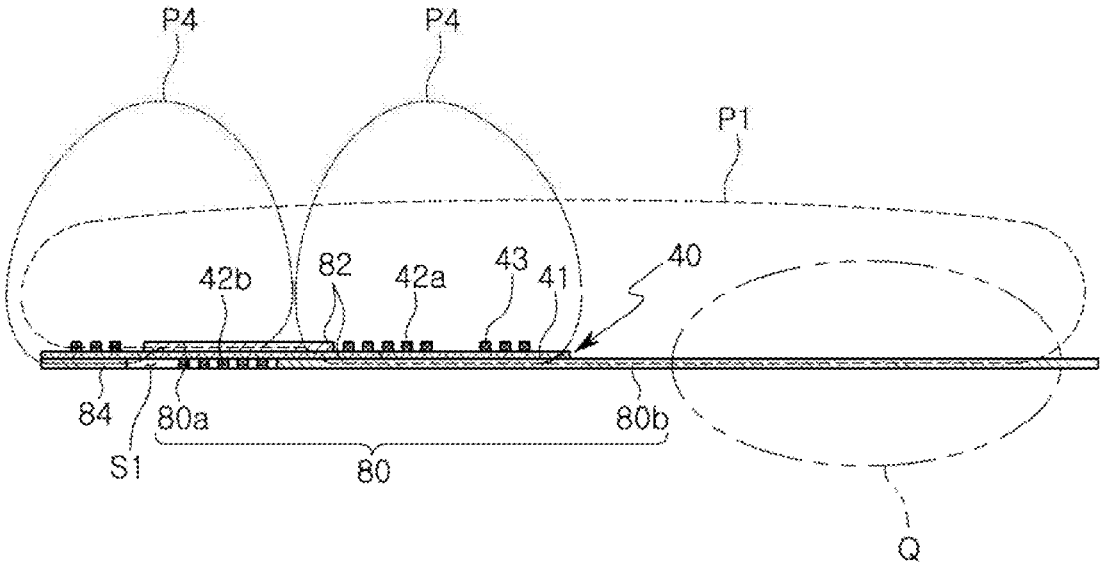
FIG. 6 is a diagram illustrating an example of a cross-sectional view taken along a line II-II' of FIG. 5.
Figure 7:
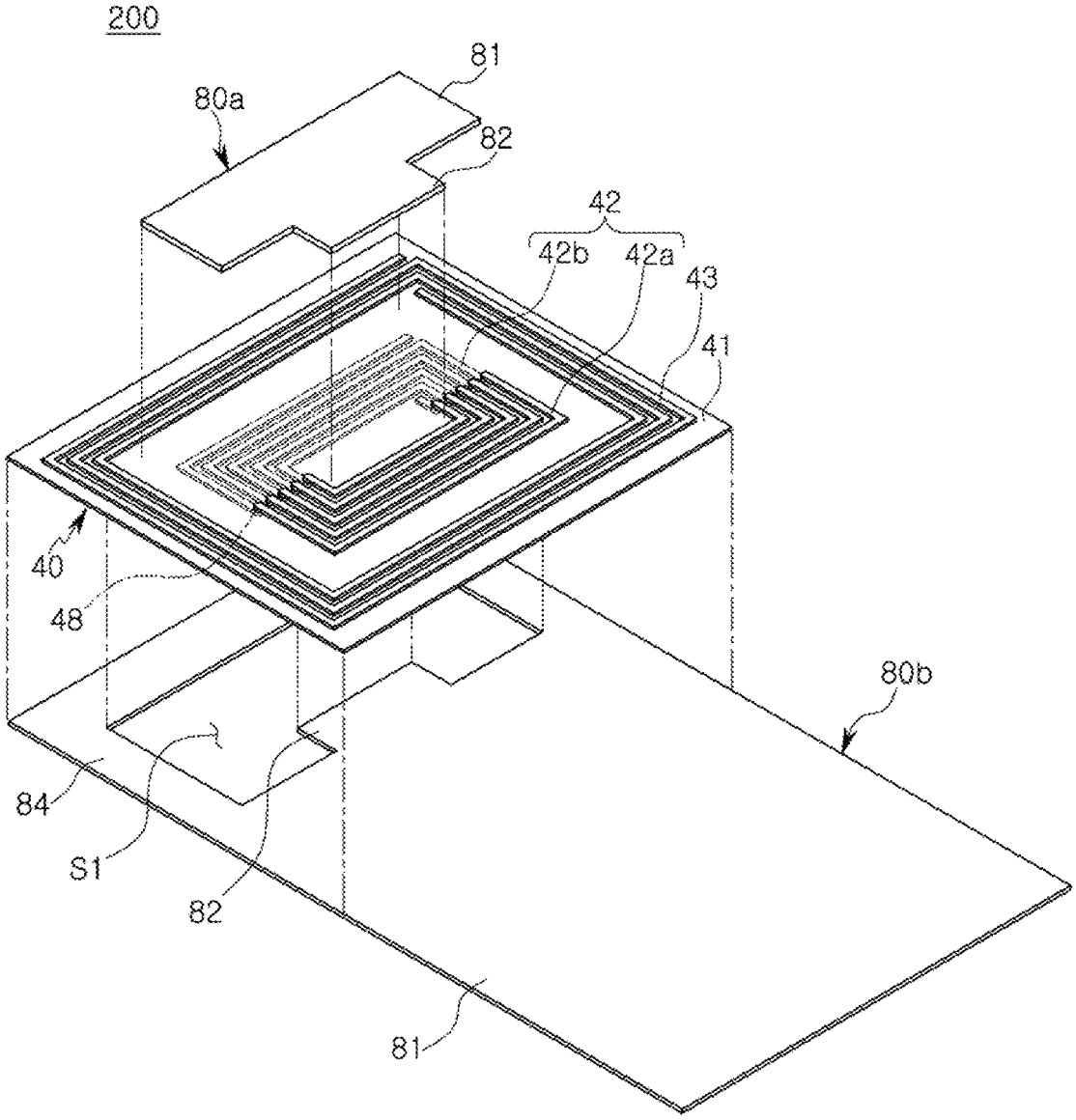
FIG. 7 is a diagram illustrating an example of the antenna module illustrated in FIG. 5.

FIG. 5 is a diagram illustrating an example of an antenna module and FIG. 6 is a cross-sectional view taken along a line II-II' of FIG. 5. FIG. 7 is a diagram illustrating an example of the antenna module illustrated in FIG. 5.

Referring to FIGS. 5 through 7, in an example, an antenna module 200 has the second magnetic part 80*b* having an area larger than that of the first magnetic part 80*a*.

In addition, the second magnetic part 80*b* may include an extending part 84 disposed below the second antenna wiring 43.

In an example, the extending part 84 extends in a band form from the body part 81 of the second magnetic part 80*b*, and may be disposed on the second surface of the insulating substrate 41. The extending part 84 may face the second antenna wiring 43 disposed around the second pattern 42*b* and supporting the second antenna wiring 43 on the second surface of the insulating substrate.

As opposite ends of the extending part 84 are connected to the body part 81, a hollow part S1 having a form of a through-hole may be formed in the extending part 84, and the second pattern 42*b* of the coil part 40 may be disposed in the hollow part S1.

In an example, the second antenna wiring 43 may be disposed along the outer portion of the insulating substrate 41. Therefore, the extending part 84 may also be disposed in the band form along the outer portion of the insulating substrate 41.

In an example, the extending part 84 may have a width that is wider than the width formed by the second antenna wiring 43.

However, the configuration of the extending part 84 are only non-exhaustive illustrations of the extending part 84, and other shapes and configuration are considered to be well within the scope of the present disclosure. For example, the extending part 84 may have the width narrower than the width of the second antenna wiring 43, or the extending part 84 may also be disposed on an outer side or inner side of the second antenna wiring 43.

When the second magnetic part 80*b* includes the extending part 84 as described above, since most of the magnetic field generated by the second antenna wiring 43 forms a magnetic path through the second magnetic part 80*b*, the leakage of the magnetic flux into the rear surface of the second magnetic part 80*b* is prevented. As a result, the radiation performance may be increased.

When the magnetic part 80 is configured as described above, the magnetic field generated by the first antenna wiring 42 may be formed as illustrated by P1 in FIG. 6. In addition, the magnetic field generated by the second antenna wiring 43 may be formed as illustrated by P4.

Therefore, even though other components are disposed in a region Q within the electronic device or the antenna wirings are not formed in the region Q due to a structural problem, the magnetic field may be extended up to around the region Q. As a result, even though the coil part 40 is formed to have a small size and is disposed at one side of the electronic device, the magnetic field may be entirely formed around the electronic device.

As such, the antenna module may change a shape or a range of the magnetic field in various forms, and as a result, the antenna module may correspond to various shapes or sizes of a portable terminal in which the antenna module is mounted.

Figure 8:
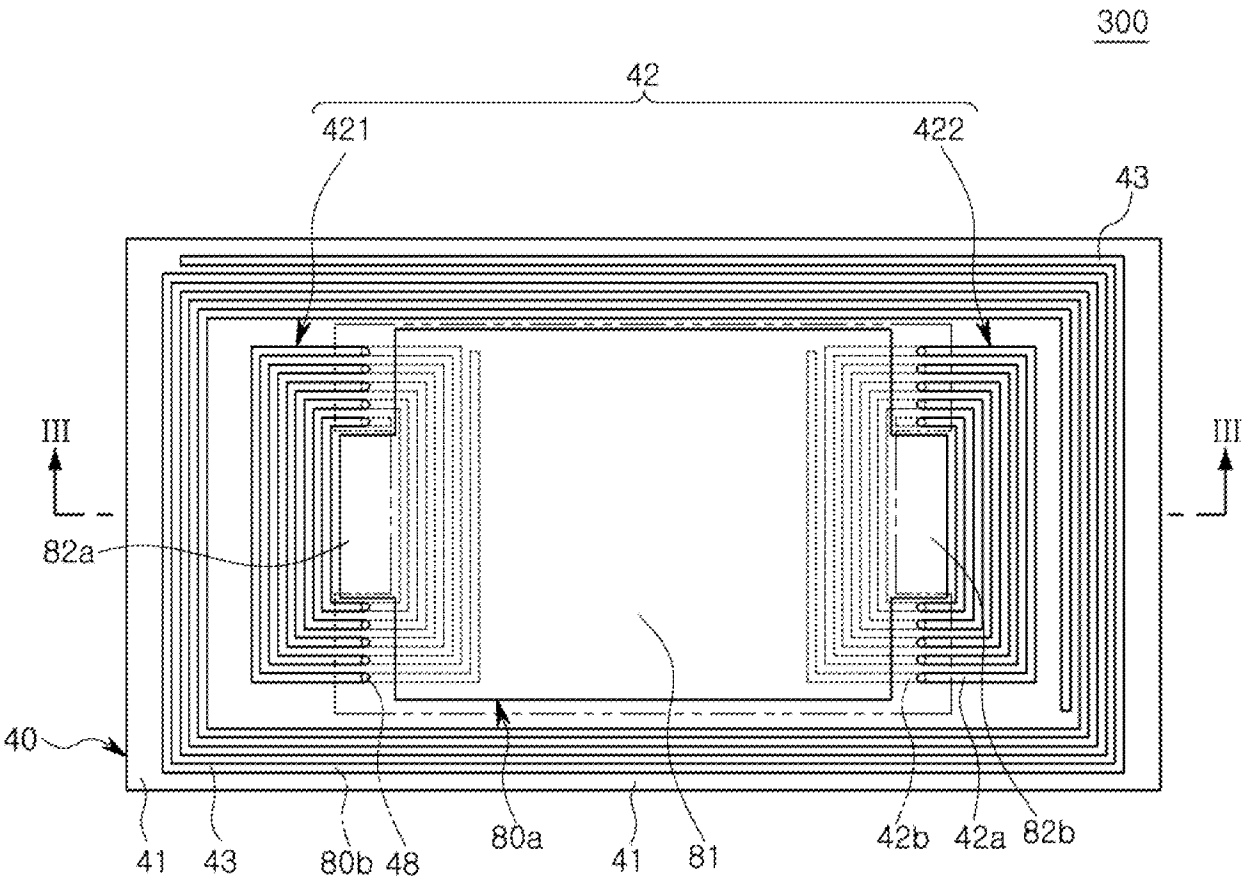
FIG. 8 is a diagram illustrating an example of an antenna module.
Figure 9:
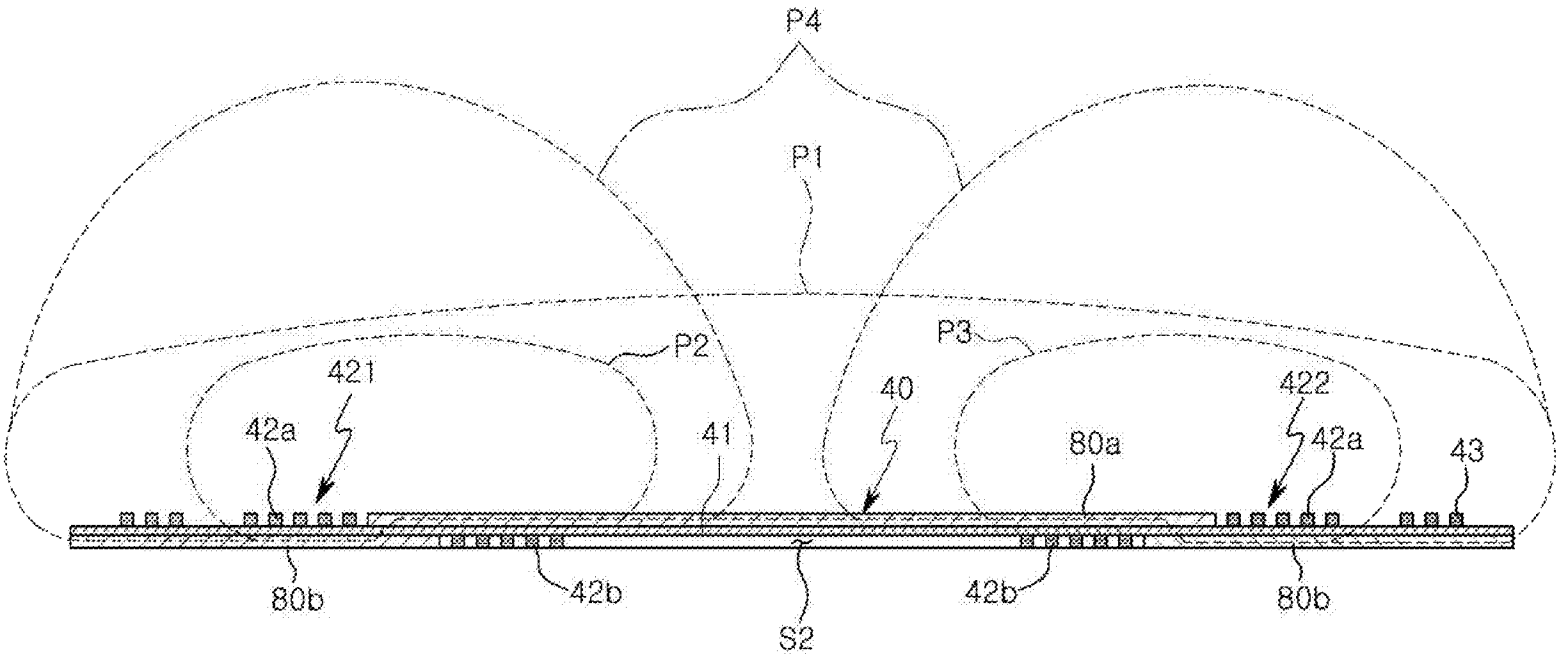
FIG. 9 is a diagram illustrating an example of a cross-sectional view taken along a line III-III' of FIG. 8.

FIG. 8 is a diagram illustrating an example of an antenna module and FIG. 9 is a cross-sectional view taken along a line III-III' of FIG. 8. In addition, FIG. 10 is an diagram illustrating an example of the antenna module illustrated in FIG. 8.

Figure 10:
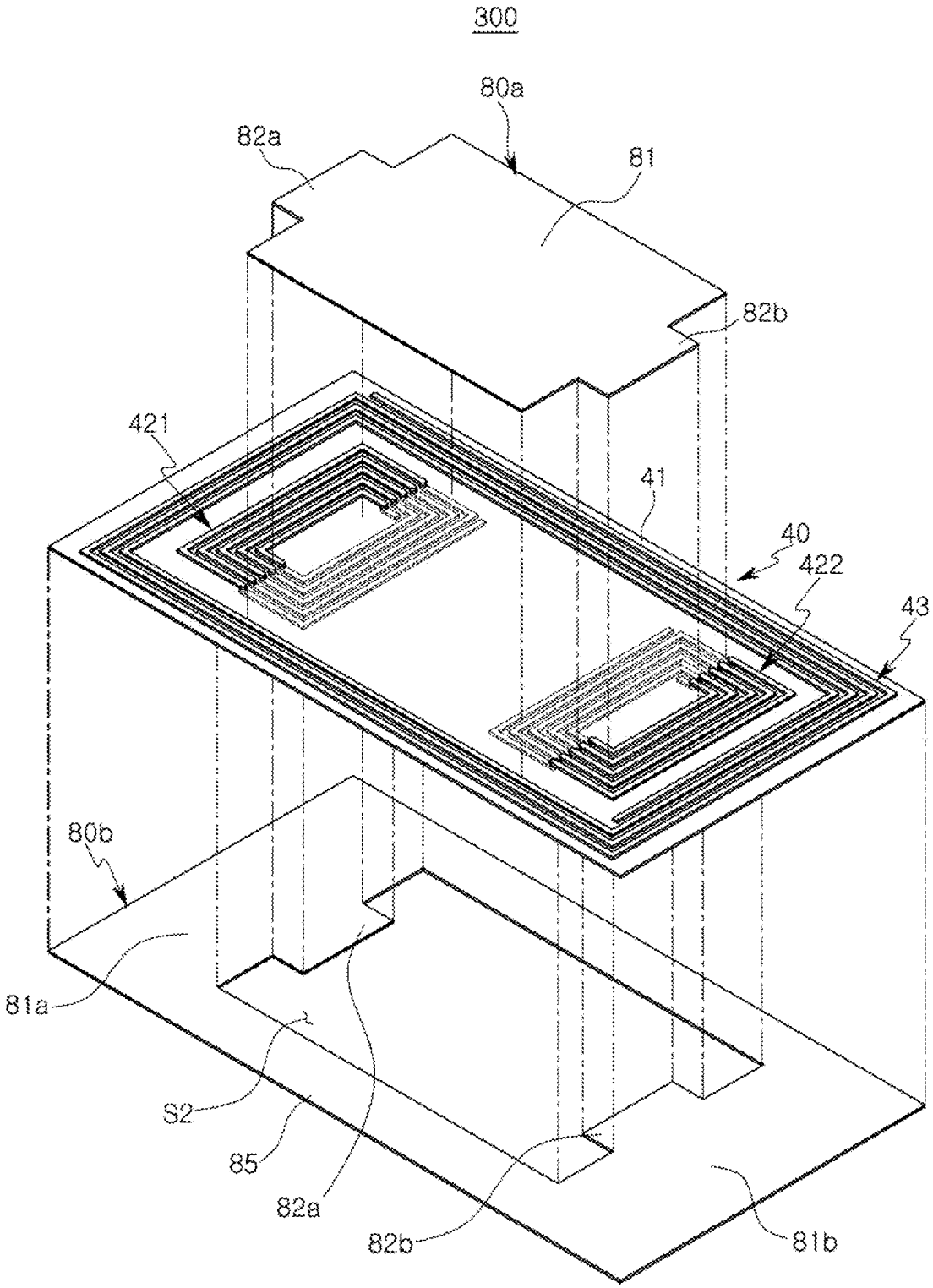
FIG. 10 is a diagram illustrating an example of the antenna module illustrated in FIG. 8.

Referring to FIGS. 8 through 10, in an example, an antenna module 300 includes a first antenna wiring 42 including a first wiring 421 and a second wiring 422.

The first wiring 421 and the second wiring 422 may be each formed on the insulating substrate 41 in a structure similar to the first antenna wiring 42 (FIG. 4) described above, and may be disposed to be spaced apart from each other by a distance.

In an example, the first wiring 421 and the second wiring 422 are each disposed so that the wiring disposed on the first surface of the insulating substrate 41 is disposed on an outer side of the wiring disposed on the second surface of the insulating substrate 41. Therefore, the first wiring 421 and the second wiring 422 may be disposed to be axial symmetrical with each other with respect to the center of the insulating substrate 41.

Accordingly, the entirety of the first magnetic part 80*a* to be described below may be disposed on the insulating substrate 41 without interfering with the first wiring 421 and the second wiring 422 disposed on the first surface of the insulating substrate 41.

In an example, the first wiring 421 and the second wiring 422 may be connected in series with or in parallel to each other (not shown). However, the first wiring 421 and the second wiring 422 are not limited thereto, but may also be configured to be operated independently from each other.

In an example, the second antenna wiring 43 accommodates the first wiring 421 and the second wiring 422 in an internal space and may be disposed in a spiral shape along an outer portion of the insulating substrate 41.

In an example, the magnetic part 80 includes the first magnetic part 80*a* disposed on the first surface of the insulating substrate 41, and the second magnetic part 80*b* disposed on the second surface of the insulating substrate 41.

The first magnetic part 80*a* may be configured so that a first magnetic flux connecting part 82*a* and a second magnetic flux connecting part 82*b* protrude toward an opposite direction from the body part 81. In an example, the first magnetic flux connecting part 82*a* may be disposed in an internal region of the first wiring 421, and the second magnetic flux connecting part 82*b* may be disposed in an internal region of the second wiring 422. Therefore, the first magnetic part 80*a* may be disposed between the first wiring 421 and the second wiring 422 disposed on the first surface of the insulating substrate 41.

In an example, the second magnetic part 80*b* has a hollow part S2 formed therein, and may be disposed so that the two magnetic flux connecting parts 82 face each other through the hollow part S2. Such a second magnetic part 80*b* may have a form in which the two second magnetic part 80*b* (FIG. 4) described above are disposed to face the magnetic flux connecting parts 82, and the two second magnetic parts 80*b* (FIG. 4) are then connected to each other.

Therefore, the second magnetic part 80*b* may include the first body part 81*a* disposed to face the first wiring 421 and the second antenna wiring 43 disposed around the first wiring 421, the second body part 81*b* disposed to face the second wiring 422 and the second antenna wiring 43 disposed around the second wiring 422, a connecting part 85 connecting the first body part 81*a* and the second connecting part 81*b* and disposed to face the second antenna wiring 43. The first magnetic flux connecting part 82*a* extends from the first body part 81*a* and is disposed in the internal region of the first wiring 421, and the second magnetic flux connecting part 82*b* extends from the second body part 81*b* and is disposed in the internal region of the second wiring 422.

The two magnetic flux connecting parts 82*a* and 82*b* that are formed in the second magnetic part 80*b* may be each disposed in the internal regions of the first wiring 421 and the second wiring 422. In addition, as illustrated in FIG. 9, the second patterns 42*b* disposed on the second surface of the insulating substrate 41 among the first wiring 421 and the second wiring 422 may be disposed in the hollow part S2 of the second magnetic part 80*b*.

As illustrated in FIG. 8, in an example, the first magnetic part 80*a* is disposed in the internal space having the spiral shape formed by the second antenna wiring 43 to expose the second antenna wiring 43. Accordingly, the first magnetic part 80*a* may be disposed in a region in which the first antenna wiring 42 is not formed in the internal space formed by the second antenna wiring 43.

Both the magnetic flux connecting parts 82*a* and 82*b* of the first magnetic part 80*a* and the second magnetic part 80*b* may be disposed in the internal region of the first wiring 421 or the internal region of the second wiring 422. Therefore, the magnetic flux connecting part 82 of the first magnetic part 80*a* and the magnetic flux connecting part 82 of the second magnetic part 80*b* may be disposed to face each other with the insulating substrate 41 interposed therebetween.

As illustrated by P1 in FIG. 9, the magnetic field formed by the first antenna wiring 42 is formed across the entirety of the first magnetic part 80*a* and the second magnetic part 80*b*. However, the magnetic field is not limited thereto, but may also be each formed around the first wiring 421 and the second wiring 422 as illustrated by P2 and P3. In addition, the magnetic field generated by the second antenna wiring 43 may be formed as illustrated by P4.

Figure 11:
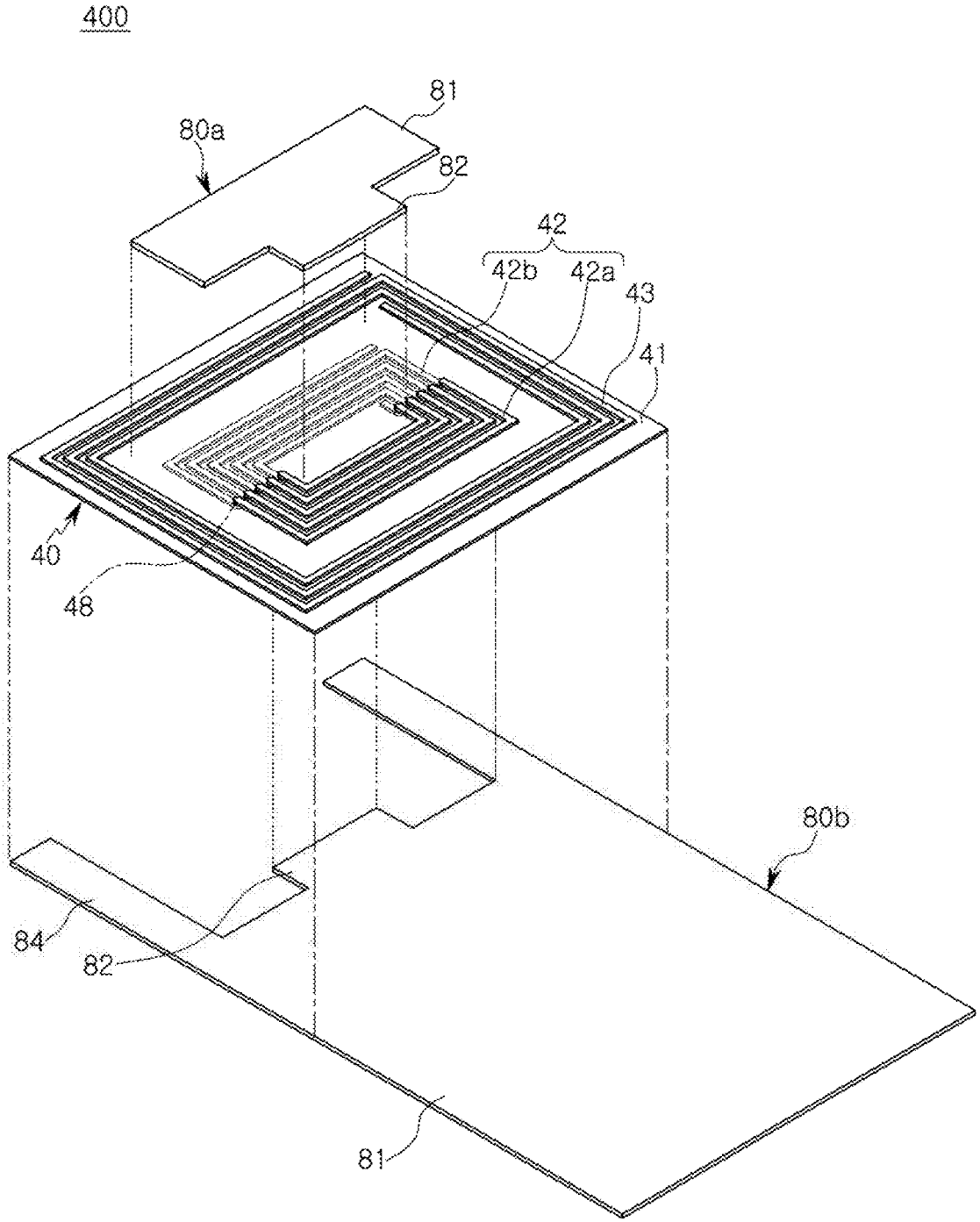
FIGS. 11 and 12 are diagrams illustrating examples of an antenna module.
Figure 12:
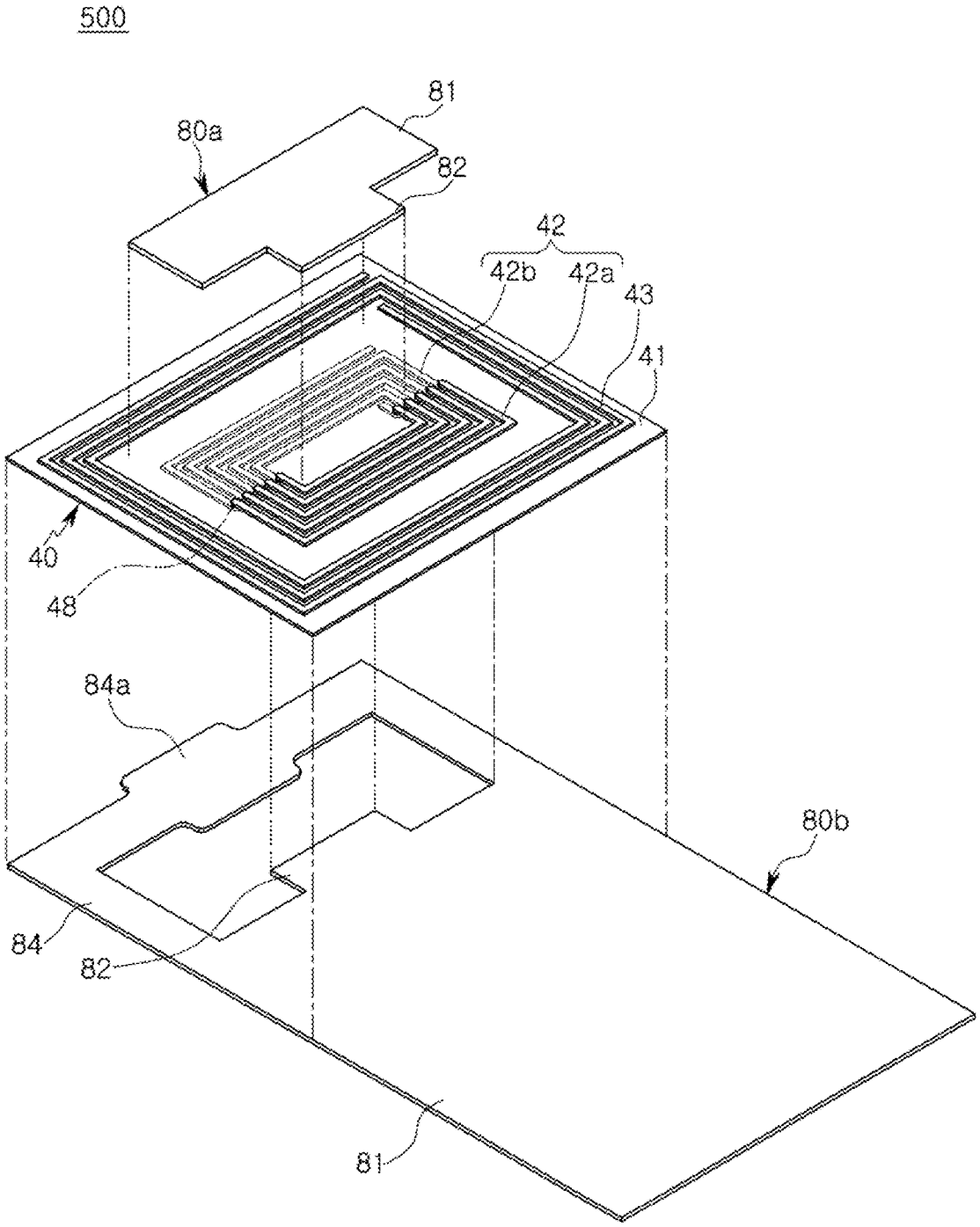

FIGS. 11 and 12 are diagrams illustrating an example of an antenna module. In addition to the description of FIGS. 11-12 below, the above descriptions of FIGS. 1-10, are also applicable to FIGS. 11-12, and are incorporated herein by reference. Thus, the above description may not be repeated here.

Antenna modules illustrated in FIGS. 11 and 12 may be configured to be similar to the antenna module illustrated in FIG. 7, and may partially have a difference in the configuration of the first magnetic part.

In an example, an antenna module 400 illustrated in FIG. 11 may be configured in a form in which the extending part 84 does not support the entirety of the second antenna wiring 43 and is partially removed.

Such a configuration may be used when it is difficult to form the extending part in a complete ring shape as illustrated in FIG. 7 due to other components disposed in the electronic device in which the antenna module 400 is mounted or due to a structural problem. In addition, such a configuration may also be applied to reduce costs for manufacturing the antenna module and to suit an operation of manufacturing the antenna module.

The illustrated examples illustrate the extending parts 84 that are linearly formed in two positions of the body part 81, but the present disclosure is not limited thereto. The extending part 84 may be formed in a variety of ways, as needed. For example, the extending part 84 may be formed in only one position of the two positions, or the extending parts 84 formed in the two positions may be formed to have different lengths.

In an example, an antenna module 500 illustrated in FIG. 12 includes a wide portion 84*a* in which an area of a portion of the extending part 84 is extended to be wider than other portions thereof.

A position at which the wide portion 84*a* is disposed or a size of the wide portion 84*a* may be defined according to a shape of the coil part 40 or a shape of the second antenna wiring 43. In an example, the position at which the wide portion 84*a* is disposed or the size of the wide portion 84*a* is defined according to shapes or functions of the components disposed on the rear surface of the second magnetic part 80*b* in the electronic device. For example, the wide portion 84*a* may have the size that completely covers the above-mentioned components to shield the components from the magnetic field.

In addition, the extending part 84 may be formed in a variety of ways, as needed. For example, although not illustrated, contrary to the wide portion 84*a*, an area of a portion of the extending part may be formed to be narrower than other portions thereof, or the extending part 84 may be configured to partially deviate from a lower portion of the second antenna wiring 43.

Figure 13:
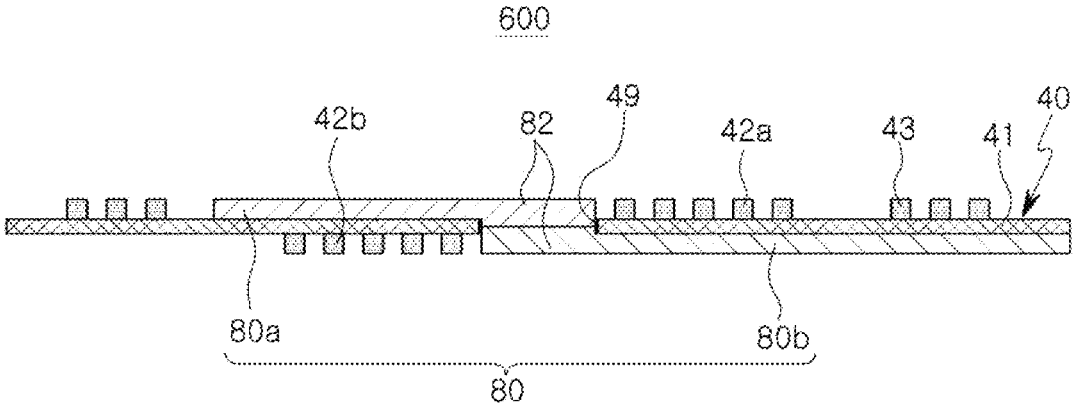
FIG. 13 is a diagram illustrating an example of an antenna module.
Figure 14:
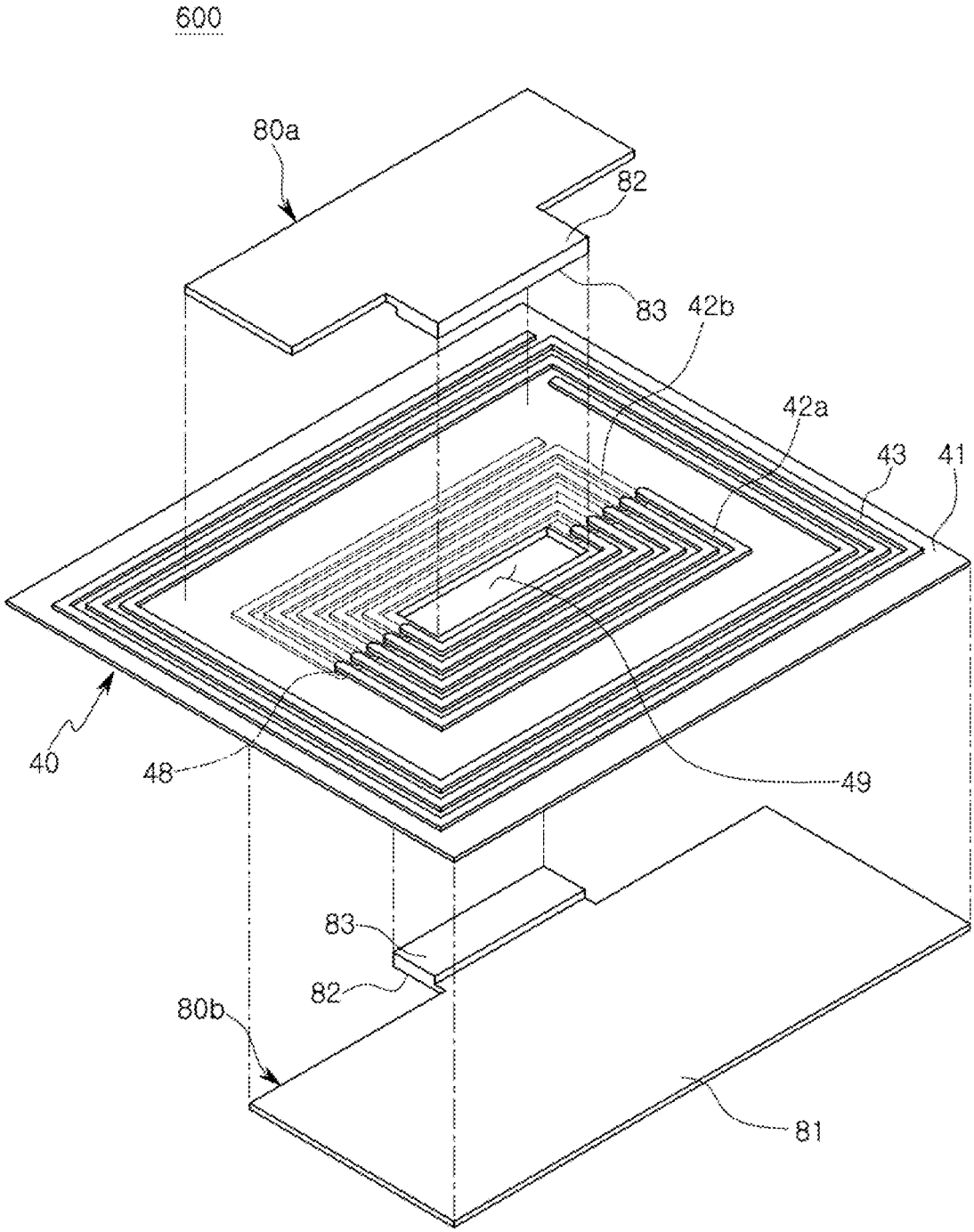
FIG. 14 is a diagram illustrating an example of the antenna module illustrated in FIG. 13.

FIG. 13 is a diagram illustrating an example of an antenna module and FIG. 14 is a diagram illustrating an example of the antenna module illustrated in FIG. 13.

Referring to FIGS. 13 and 14, the coil part 40 of an antenna module 600 has a through-hole 49 formed in a portion corresponding to the center region of the first antenna wiring 42. In an example, the through-hole 49 penetrates through the insulating substrate 41.

In an example, the magnetic flux connecting parts 82 of the first magnetic part 80*a* and the second magnetic part 80*b* may include insertion portions 83 inserted into the through-hole 49.

In an example, as shown in FIG. 14, the insertion portion 83 of the first magnetic part 80*a* and the insertion portion 83 of the second magnetic part 80*b* may be coupled to each other while being in surface-contact with each other.

In an example, where the first magnetic part 80*a* and the second magnetic part 80*b* are directly in contact with each other, the magnetic flux resistance may be further decreased, thereby further increasing efficiency of the antenna module 400.

Figure 15:
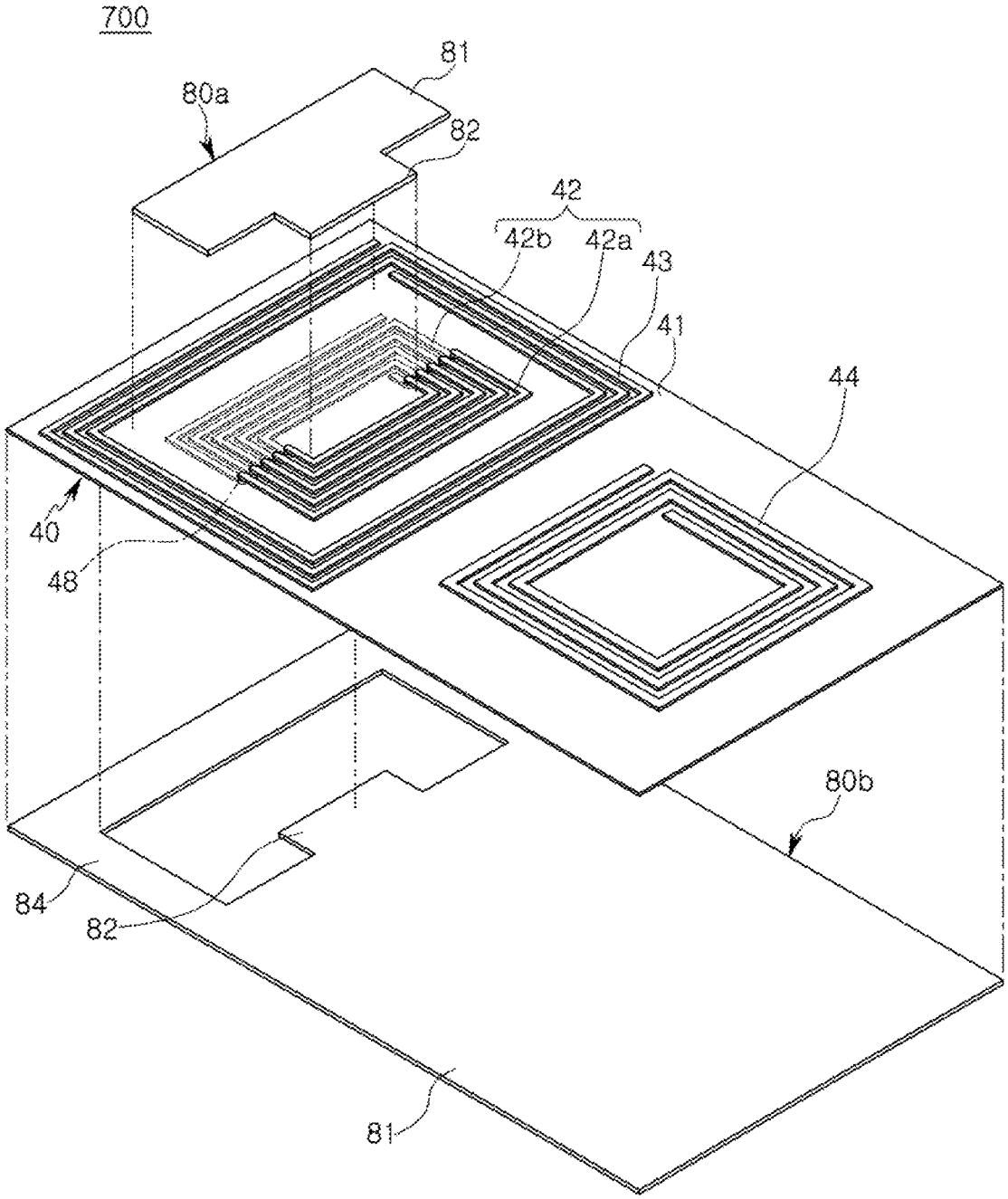
FIG. 15 is a diagram illustrating an example of an antenna module.

FIG. 15 is a diagram illustrating an example of an antenna module.

Referring to FIG. 15, an antenna module 700 has the coil part 40 including a third antenna wiring 44.

The third antenna wiring 44, which is a power receiving wiring, may be formed as a wiring having a spiral shape, similar to the second antenna wiring 43.

In an example, the third antenna wiring 44 is formed on the first surface of the insulating substrate 41, similar to the second antenna wiring 43. However, the third antenna wiring 44 is not limited thereto, and may be formed on the opposite surfaces of the insulating substrate 41 or formed on the second surface of the insulating substrate 41, similarly to the first antenna wiring 42. In an example, the third antenna wiring is formed in a variety of ways. For example, the third antenna wirings may be formed in the same spiral shape on the opposite surfaces of the insulating substrate 41 and the third antenna wirings may be connected in series with or in parallel to each other.

In an example, at least a portion of the second magnetic part 80*b* is disposed to face the third antenna wiring 44. In an example, the second magnetic part 80*b* is configured to face a portion of the first antenna wiring 42 (e.g., the first pattern), the entirety of the second wiring 43, and the entirety of the third antenna wiring 44. However, the second magnetic part 80*b* is not limited thereto, but may be formed in a variety of ways, as needed. For example, the second magnetic part 80*b* may be configured to partially face the second antenna wiring 43 and the third antenna wiring 44.

In an example, the third antenna wiring 44 may be disposed in an external region of the second antenna wiring 43, not an internal region thereof. However, the configuration of the present disclosure is not limited thereto, but may be formed in a variety of ways, as needed. For example, the size of the second antenna wiring 43 may be extended and the third antenna wiring 44 may be disposed in the internal region of the second antenna wiring 43.

In an example, the third antenna wiring 44 is used as a wireless charging coil. However, the third antenna wiring 43 is not limited thereto.

Figure 16:
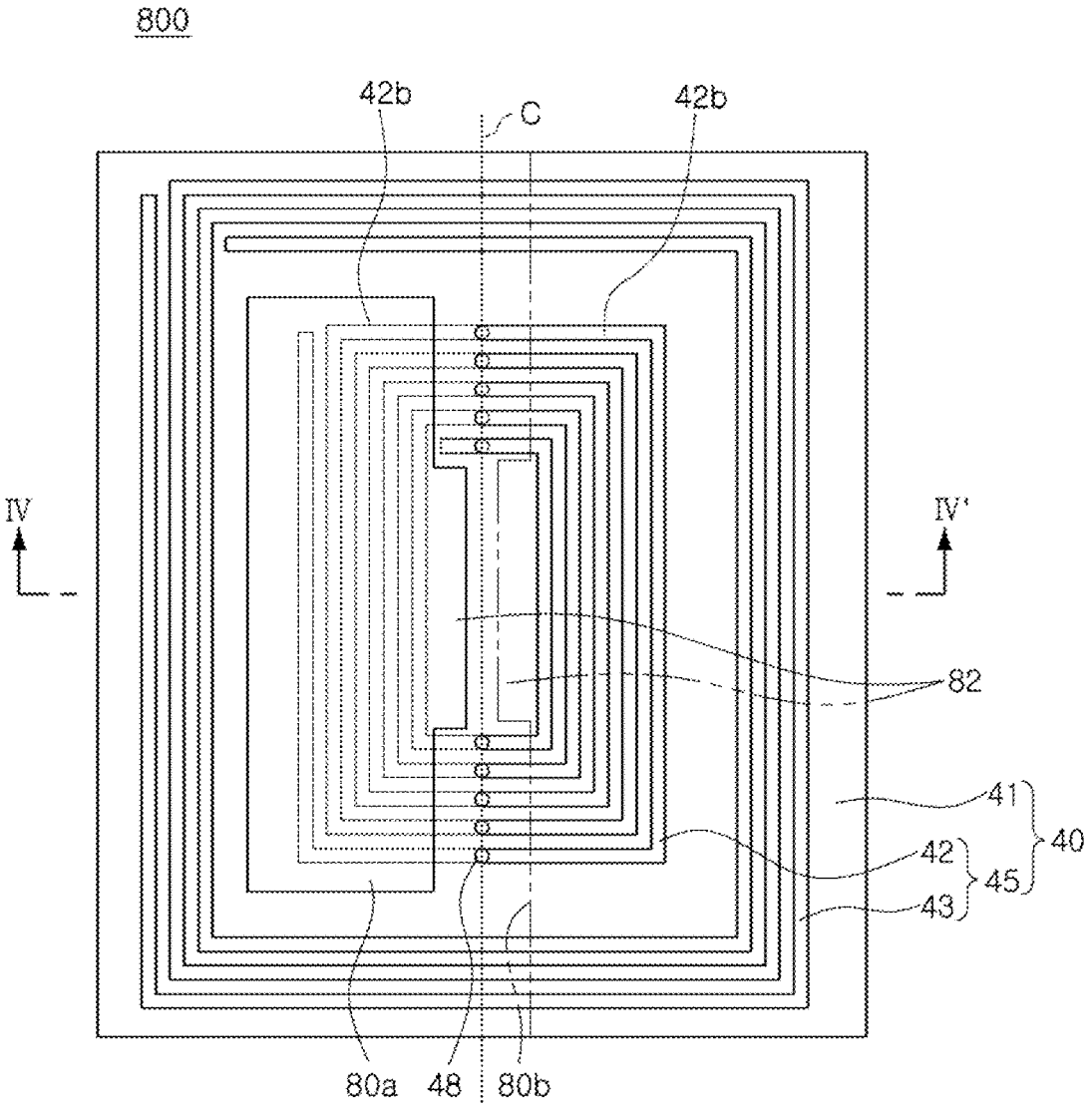
FIG. 16 is a diagram illustrating an example of an antenna module.
Figure 17:
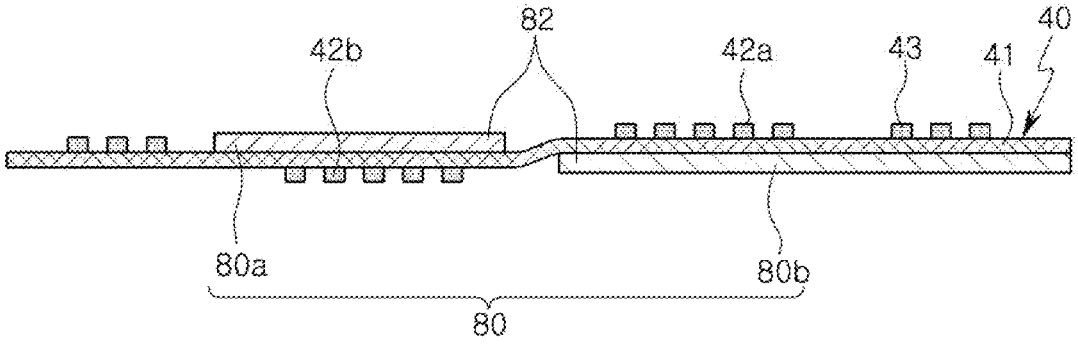
FIG. 17 is a diagram illustrating an example of a cross-sectional view taken along a line IV-IV' of FIG. 16.

FIG. 16 is a diagram illustrating an example of an antenna module and FIG. 17 is a cross-sectional view taken along a line IV-IV' of FIG. 16.

Referring to FIGS. 16 and 17, in an example, an antenna module 800 has the magnetic flux connecting parts 82 of the first magnetic part 80*a* and the second magnetic part 80*b* which are disposed so as not to overlap each other. Therefore, the magnetic flux connecting part 82 may have a size smaller than that of the magnetic flux connecting part described above. In an example, the magnetic flux connecting part 82 of the first magnetic part 80*a* and the magnetic flux connecting part 82 of the second magnetic part 80*b* may be disposed in a surface direction of the insulating substrate 41 so as not to overlap each other.

In an example, the coil part 40 is formed so that the thicknesses of the antenna wirings 42 and 43 are thinner than those of the magnetic parts 80.

In such a configuration, when the antenna module 800 is pressed in a vertical direction, the coil part 40 having flexibility may be bent and the first magnetic part 80*a* and the second magnetic part 80*b* may be disposed to be closely in contact with each other, as illustrated in FIG. 17. Therefore, a thickness of the antenna module 800 may be further reduced.

Figure 18:
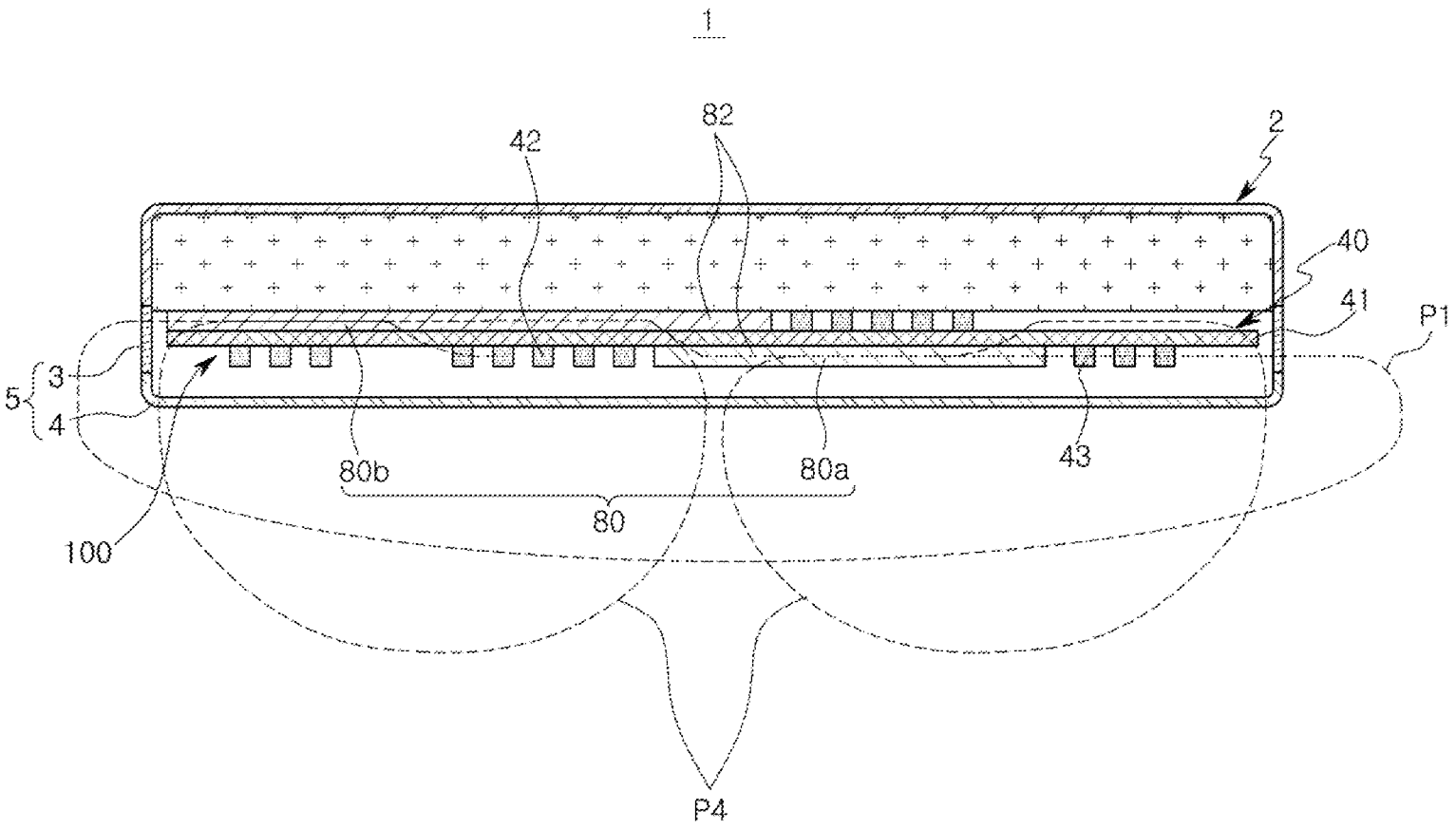
FIG. 18 is a diagram illustrating an example of a cross-sectional view illustrating an electronic device.

FIG. 18 is a diagram illustrating an example of an electronic device.

Referring to FIG. 18, an electronic device 1, which is a portable terminal including the antenna module 100 (FIG. 1) described above, may perform local area network communications through the antenna module 100.

The electronic device 1 may include a terminal body 2, a case 5, and the antenna module 100. The antenna module 100 may be disposed in an inner space formed by the terminal body 2 and the case 5.

The case 5 may include a side cover 3 and a rear cover 4. In an example, the side cover 3 and the rear cover 4 are formed of the same material. In another example, the side cover 3 and the rear cover 4 are formed of different materials.

The first magnetic part 80*a* and the second magnetic part 80*b* may have sides disposed to face the side cover 3.

Accordingly, the magnetic field formed by the first antenna wiring 42 may be formed to penetrate through the side of the case 5 as illustrated by P1 in FIG. 18. Therefore, the side cover 3 may be formed of a material that does not shield the magnetic flux.

In an example, the magnetic field formed by the second antenna wiring 43 is formed to penetrate through the rear cover 4 of the case 5 as illustrated by P4. In an example, although not illustrated, when a size of the magnetic field formed by the second antenna wiring 43 is extended, the magnetic field may be formed to penetrate through both the rear cover 4 and the side cover 3. Therefore, both the rear cover 4 and the side cover 3 may be formed of the material that does not shield the magnetic flux.

In an example, the electronic device described is embodied or incorporated in various types of products such as, for example, a cellular phone, a smartphone, an intelligent agent, a mobile phone, a wearable smart device (such as, a ring, a watch, a pair of glasses, glasses-type device, a bracelet, an ankle bracket, a belt, a necklace, an earring, a headband, a helmet, a device embedded in the cloths, or an eye glass display (EGD)), a server, a personal computer (PC), a laptop, a notebook, a subnotebook, a netbook, an ultra-mobile PC (UMPC), a tablet personal computer (tablet), a phablet, a mobile internet device (MID), a personal digital assistant (PDA), an enterprise digital assistant (EDA), a digital camera, a digital video camera, a portable game console, an MP3 player, a portable/personal multimedia player (PMP), a handheld e-book, an ultra mobile personal computer (UMPC), a portable lab-top PC, a global positioning system (GPS) navigation, a personal navigation device, portable navigation device (PND), a handheld game console, an e-book, a high definition television (HDTV), a smart appliance, communication systems, image processing systems, graphics processing systems, various Internet of Things (IoT) devices that are controlled through a network, a smart vehicle, an intelligent automobile, an autonomous driving vehicle, other consumer electronics/information technology (CE/IT) device, or any other device capable of wireless communication or network communication consistent with that disclosed herein.).

As set forth above, disclosed is an antenna module for use in an electronic device, such as a portable terminal. The antenna module is used for local area network communications, and a plurality of antennas are efficiently disposed in the antenna module.

As set forth above, since the antenna module is manufactured by stacking the first magnetic part and the second magnetic part on the opposite surfaces of the coil part, the antenna module may be easily manufactured.

Further, since one antenna module includes the two antenna wirings having different radiation directions, the plurality of local area network communications are possible even though one antenna module is mounted in the electronic device.

While this disclosure includes specific examples, it will be apparent after gaining a thorough an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module comprising:

a coil part comprising a second antenna wiring formed on an insulating substrate in a spiral shape and a first antenna wiring disposed in an internal region of the second antenna wiring; and a magnetic part comprising a first magnetic part disposed in the internal region of a first surface of the insulating substrate and a second magnetic part disposed on a second surface of the insulating substrate, wherein the entirety of the first magnetic part is disposed in the internal region of the second antenna wiring, and wherein the first magnetic part and the second magnetic part are disposed to face each other in the internal region of the first antenna wiring with the insulating substrate interposed therebetween.

2. The antenna module of claim 1, wherein the first antenna wiring comprises:

a first pattern disposed on the first surface of the insulating substrate;

a second pattern disposed on the second surface of the insulating substrate; and interlayer connection conductors penetrating the insulating substrate and being configured to connect the first pattern to the second pattern.

3. The antenna module of claim 2, wherein the first magnetic part is disposed in a portion of the internal region where the first pattern is not formed.

4. The antenna module of claim 3, wherein the first magnetic part comprises:

a body part disposed to face the second pattern; and a magnetic flux connecting part extending from the body part of the first magnetic part, and being disposed in an internal region of the first antenna wiring.

5. The antenna module of claim 2, wherein the second magnetic part comprises:

a body part disposed to face the first pattern and the second antenna wiring disposed around the first pattern;

a magnetic flux connecting part disposed in an internal region of the first antenna wiring; and an extending part disposed to face the second antenna wiring disposed around the second pattern.

6. The antenna module of claim 5, wherein the extending part extends from the body part and is formed as a band along an outer portion of the insulating substrate.

7. The antenna module of claim 5, wherein an area of the extending part is wider than areas of other portions.

8. The antenna module of claim 5, wherein the extending part extends from the body part and is disposed to support a portion of the second antenna wiring disposed around the second pattern.

9. The antenna module of claim 1, wherein the first antenna wiring comprises a first wiring and a second wiring, spaced apart from each other, and the first magnetic part comprises a first magnetic flux connecting part disposed in an internal region of the first wiring and a second magnetic flux connecting part disposed in an internal region of the second wiring.

10. The antenna module of claim 1, further comprising a third antenna wiring disposed on the first surface of the insulating substrate, and a portion of the second magnetic part is configured to face the third antenna wiring.

11. The antenna module of claim 1, wherein the first antenna wiring protrudes from the substrate, and a height of the protrusion of the first antenna wiring is similar to a thickness of the magnetic part.

12. The antenna module of claim 1, wherein the second antenna wiring protrudes from the substrate, and a height of the protrusion of the second antenna wiring is similar to a thickness of the magnetic part.

13. The antenna module of claim 1, wherein a size of the first magnetic part is different from a size of the second magnetic part.

14. An antenna module comprising:

a coil part comprising a second antenna wiring formed on an insulating substrate in a spiral shape and a first antenna wiring disposed in an internal region of the second antenna wiring; and a magnetic part comprising a first magnetic part disposed in the internal region of a first surface of the insulating substrate and a second magnetic part disposed on a second surface of the insulating substrate, wherein the entirety of the first magnetic part is disposed in the internal region of the second antenna wiring, wherein the first antenna wiring comprised a first wiring and a second wiring, spaced apart from each other, wherein the first magnetic part comprises a first magnetic flux connecting part disposed in an internal region of the first wiring and a second magnetic flux connecting part disposed in an internal region of the second wiring, and wherein the second magnetic part comprises:

a first body part disposed to face the first wiring and the second antenna wiring disposed around the first wiring;

a first magnetic flux connecting part extended from the first body part and disposed in the internal region of the first wiring;

a second body part disposed to face the second wiring and the second antenna wiring disposed around the second wiring;

a second magnetic flux connecting part extended from the second body part and disposed in the internal region of the second wiring; and a connecting part connecting the first body part to the second body part and being disposed to face the second antenna wiring.

15. An antenna module comprising:

a coil part comprising a second antenna wiring formed on an insulating substrate in a spiral shape and a first antenna wiring disposed in an internal region of the second antenna wiring; and a magnetic part comprising a first magnetic part disposed in the internal region of a first surface of the insulating substrate and a second magnetic part disposed on a second surface of the insulating substrate, wherein the entirety of the first magnetic part is disposed in the internal region of the second antenna wiring, wherein the first antenna wiring comprises:

a first pattern disposed on the first surface of the insulating substrate;

a second pattern disposed on the second surface of the insulating substrate; and interlayer connection conductors penetrating the insulating substrate and being configured to connect the first pattern to the second pattern, wherein the first magnetic part is disposed in a portion of the internal region where the first pattern is not formed, and the first magnetic part comprises:

a body art disposed to face the second pattern; and a magnetic flux connecting part extending from the body part of the first magnetic part, and being disposed in an internal region of the first antenna wiring, and wherein the second magnetic part comprises:

a body part disposed to face the first pattern and the second antenna wiring disposed around the first pattern; and a magnetic flux connecting part extending from the body part of the second magnetic part, and being disposed in the internal region of the first antenna wiring, and the magnetic flux connecting part of the first magnetic part is spaced apart from the magnetic flux connecting part of the second magnetic part are disposed in a surface direction of the insulating substrate.

16. An antenna module comprising:

a first antenna wiring dispersedly disposed on a first surface and a second surface of an insulating substrate;

a first magnetic part disposed on the first surface of the insulating substrate and disposed to be spaced apart from the first antenna wiring;

a second magnetic part disposed on the second surface of the insulating substrate and disposed to be spaced apart from the first antenna wiring; and a second antenna wiring disposed on the first surface of the insulating substrate and disposed around the first antenna wiring and the first magnetic part, wherein the first magnetic part and the second magnetic part are disposed to face each other in the internal region of the first antenna wiring with the insulating substrate interposed therebetween.

17. The antenna module of claim 16, wherein a portion of the first magnetic part is disposed to face the first antenna wiring disposed on the second surface of the insulating substrate, and a portion of the second magnetic part is disposed to face the first antenna wiring disposed on the first surface of the insulating substrate.

18. The antenna module of claim 17, wherein the second magnetic part is disposed to face at least a portion of the second antenna wiring.

19. An antenna module comprising:

a first antenna wiring formed along the edges of a first surface of an insulating substrate, a second antenna wiring formed inside the first antenna wiring, the second wiring comprising a first pattern disposed on the first surface, a second pattern disposed on a second surface of the insulating substrate that opposes the first surface, interlayer connection conductors penetrating the insulating substrate to connect the first pattern to the second pattern; and a first magnetic part disposed on portions of the first surface where the first pattern is absent and a second magnetic part disposed on portions of the second surface where the second pattern is absent, wherein the first magnetic part and the second magnetic part are disposed to face each other in the internal region of the first antenna wiring with the insulating substrate interposed therebetween.

20. The antenna module of claim 19, wherein the insulating substrate is divided by the interlayer connection conductors, and the first pattern is disposed on one side of the interlayer connection conductors and the second pattern is disposed on the other side of the interlayer connection conductors.

* * * * *